US008876233B2

(12) United States Patent
Laible

(10) Patent No.: US 8,876,233 B2
(45) Date of Patent: Nov. 4, 2014

(54) REFRIGERATION DEVICE

(75) Inventor: Karl-Friedrich Laible, Langenau (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 1963 days.

(21) Appl. No.: 11/801,072

(22) Filed: May 7, 2007

(65) Prior Publication Data

US 2007/0257589 A1 Nov. 8, 2007

(30) Foreign Application Priority Data

May 8, 2006 (DE) ..... 20 2006 007 336 U

(51) Int. Cl.
*A47B 96/04* (2006.01)
*F25D 23/02* (2006.01)
*F25D 23/08* (2006.01)

(52) U.S. Cl.
CPC ..... *F25D 23/02* (2013.01); *F25D 23/087* (2013.01); *F25D 2323/021* (2013.01)
USPC ..... 312/405; 312/324

(58) Field of Classification Search
USPC ..... 312/405, 326–329, 296, 324; 49/381, 49/475.1; 16/236, 237, 382, 319; 292/288, 292/DIG. 17
See application file for complete search history.

(56) References Cited

U.S. PATENT DOCUMENTS

| | | | | | |
|---|---|---|---|---|---|
| 1,918,865 | A | * | 7/1933 | Purdy | 49/313 |
| 4,070,728 | A | * | 1/1978 | Herman | 16/243 |
| 4,711,098 | A | * | 12/1987 | Kuwabara et al. | 62/441 |
| 4,991,259 | A | * | 2/1991 | Finkelstein et al. | 16/312 |
| 5,411,328 | A | * | 5/1995 | You | 312/405 |
| 5,694,789 | A | * | 12/1997 | Do | 62/441 |
| 5,713,105 | A | * | 2/1998 | Toomey | 16/245 |
| 7,334,293 | B2 | * | 2/2008 | Erickson et al. | 16/243 |
| 2005/0046319 | A1 | * | 3/2005 | Chekal et al. | 312/401 |

FOREIGN PATENT DOCUMENTS

JP 2004-176940 4/2004

OTHER PUBLICATIONS

European Search Report issued in European Application No. 07107088 dated Jan. 29, 2014.

* cited by examiner

*Primary Examiner* — Darnell Jayne
*Assistant Examiner* — Andres F Gallego
(74) *Attorney, Agent, or Firm* — Nixon & Vanderhye, P.C.

(57) ABSTRACT

A refrigeration device including a body and a first and a second door which jointly define an inner chamber. The first door bears an upright member which engages in the inner chamber and comes in contact with the first and the second door on their inner side in the closed position of the doors and which may be pivoted on opening the first door to pass the second door. The upright member is adjustable in height relative to the body.

23 Claims, 4 Drawing Sheets

Section A - A

REFRIGERATION DEVICE

This application claims priority to German Application No. 202006007336.1, filed May 8, 2006.

BACKGROUND OF THE INVENTION

The present invention relates to a refrigeration device comprising a body and a first and a second door which jointly define an inner chamber, the first door bearing an upright member which engages in the inner chamber and comes in contact with the first and the second door on their inner side in the closed position of the doors and which can be pivoted on opening the first door to pass the second door. Such a refrigeration device is known from U.S. Pat. No. 4,711,098.

The upright member is used to seal a gap between the doors when these are located in the closed position. In order to fulfil this task, the height of the upright member must agree with the height of the inner chamber into which it engages apart from a small play. The greater the play, the more air can pass between the ends of the upright member and the bottom or the roof of the body. The smaller the play, however, the larger the risk of the bottom or the roof of the body grinding or impacting against the upright member, making it difficult to open and close the doors and resulting in frictional wear or even preventing the first door from completely closing.

There is therefore a need for a refrigeration device which ensures both effective sealing between the doors and also unhindered opening and closing.

BRIEF SUMMARY OF THE INVENTION

This object is achieved in a refrigeration device of the type specified initially by making the upright member adjustable in height relative to the body.

In this case, it is appropriate if the upright member is adjustable in height relative to the first door. Since the upright member is fixed to the first door, it is comparatively simple to make the upright member adjustable relative to the first door. The upright member can also be adjusted in height relative to the body as a result of the adjustability relative to the door.

The height adjustment can be embodied in steps or continuously, in which case an eccentric arrangement which acts positively on the supporting bolt could be envisaged, for example, for the continuous height adjustment.

Advantageously, the first door bears the upright member by means of a suspension device which comprises a vertical channel and a supporting bolt which can be fixed at different heights in the channel. The height-adjustable fixing of the upright member can thus be implemented simply and cost-effectively. In this case, the supporting bolt can be fixed on the door and the channel on the upright member or conversely.

As a consequence of an advantageous further development, the channel is closed at one end and a removable locking element is attached in the channel between the closed end and the supporting bolt. The height adjustability can be ensured by the supporting bolt abutting against the locking element or, if the locking element is removed, against the closed end of the channel.

As a result of another further development, the locking element can be placed in the channel in at least two positions which block the channel at different widths. The supporting bolt is thus held in the channel at different heights. This provides another possibility for ensuring the height adjustability of the upright member.

In order to achieve the at least two positions of the locking element, the channel has at least two vertically spaced contours at which the locking element can engage.

In another embodiment of the invention, the channel has at least one contour at which the locking element can engage in different orientations. Depending on the orientation which the locking element has at the locking contour, it can block the channel at different widths.

More appropriately, the supporting bolt has a head which engages in an undercut of the channel. This prevents the supporting bolt from being able to leave the channel in a direction other than its longitudinal direction.

In another embodiment of the invention, the supporting bolt and one wall of the channel define at least one wedge-shaped cavity in which a finger of a locking component engages. If the supporting bolt is displaced in the channel, the finger is pressed against the wall and thus blocks the movement of the supporting bolt. The supporting bolt can only leave the channel if the locking component has been previously removed.

The locking component is preferably held non-positively in the channel. The locking component can thus be held simply in the channel.

Alternatively, the locking component can be held positively in the channel. Thus, the locking component can hold particularly high forces in the channel.

It can be advantageous if the form closure is produced by a locking notch and a locking projection which engages in the locking notch, wherein of said locking notch and said locking projection, one is formed on the finger and the other is formed on the wall of the channel defining the wedge-shaped cavity. If, during a displacement of the supporting bolt, the finger is pressed against the wall of the channel, the locking projection is simultaneously pressed into the locking notch with increased force and the locking component is additionally secured against displacement in this way.

In a further development of the invention, the locking notch is a through opening in the wall of the channel. The locking projection can thus be pressed from the locking notch from the outer side of the wall by means of an aid.

In another embodiment, a plurality of locking notches are provided at different heights. Depending on the position of the supporting bolt in the channel, a different number of these locking notches are reachable for the locking component. By sliding the locking component into the channel until it engages in the last reachable locking notch, the freedom of movement of the supporting bolt in the channel is minimised.

BRIEF DESCRIPTION OF THE DRAWINGS

Further features and advantages of the invention are obtained from the following description of exemplary embodiments with reference to the appended figures. In the figures.

DETAILED DESCRIPTION OF EXEMPLARY EMBODIMENTS OF THE PRESENT INVENTION

Figure 1:
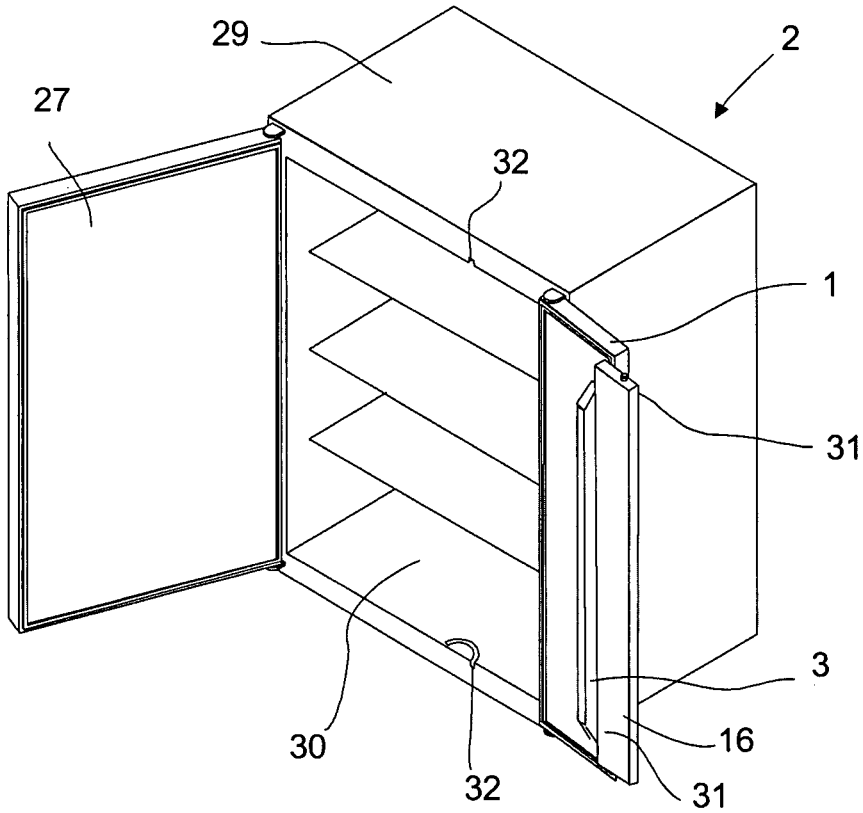
FIG. 1 is a refrigeration device with French doors and a pivotable upright member.

FIG. 1 shows a refrigeration device 2 comprising a box-shaped body 29, which is open at the front and which has two doors 1, 27 hinged to its side walls. The body 29 and the two doors 1, 27 define an inner chamber 30 of the refrigeration device 2. A pivotable upright member 16 is hinged to the first door 1 by means of two suspension devices 28 shown in FIG. 3. When the doors 1, 27 are closed and abut against the front side of the body 29, the upright member 16 is located in the inner chamber 30 where it extends over its total height apart from a slight play and covers a gap between facing flanks of the doors 1, 27. The pivotable upright member 16 bears pins 31 at both ends, which engage in guide grooves 32 formed at the bottom and roof of the body 29. The guide grooves 32 each have a closed end and an end open towards the front side of the body 29. When the door 1 is closed, the pins 31 are each located in the vicinity of the closed ends of the grooves 32; when the door 1 is opened, these pins slide in the guide grooves towards the open end and thereby force the upright member 16 to execute a pivoting movement. When the pins 31 have each reached the end of the groove 32, the upright member 16 is pivoted by about 90° so that it no longer projects laterally beyond the flank of the door 1 but instead abuts against a vertical upright member 3 which projects from the inner side of the door 1. This abutment against the upright member 3 ensures that during subsequent closure of the door 1, the pins 31 slide back into the grooves 32 and the upright member 16 is pivoted in the reverse direction.

For better clarity the pivotable upright member 16 is not shown in FIG. 1 in the position abutting against the upright member 3, normally adopted when the door is open but in the orientation pivoted through about 90° compared to this, which it adopts when the door 1 is closed.

The suspension devices 28 have the same design. For better clarity, only the upper of the two suspension devices 28 is described hereinafter.

Figure 3:
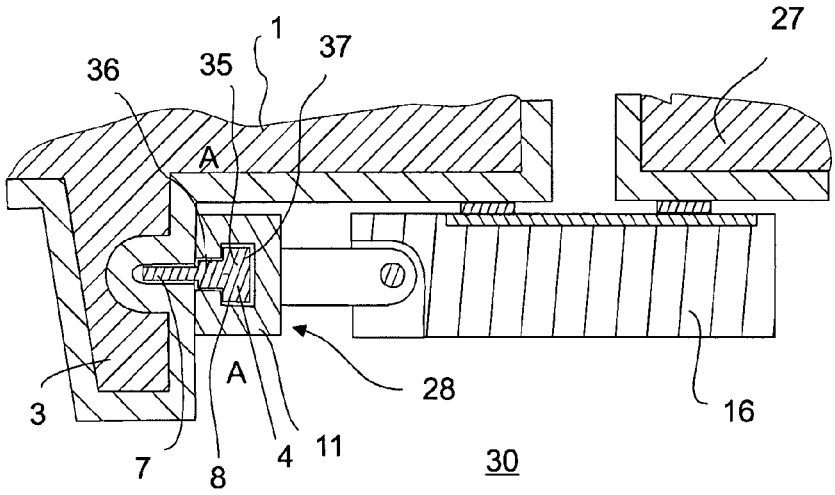
FIG. 3 is a cross section of the pivotable upright member with the fastening device.

The upper suspension device 28 comprises a supporting bolt 4 and a supporting bolt receptacle 11 as shown in FIG. 3.

Figure 2:
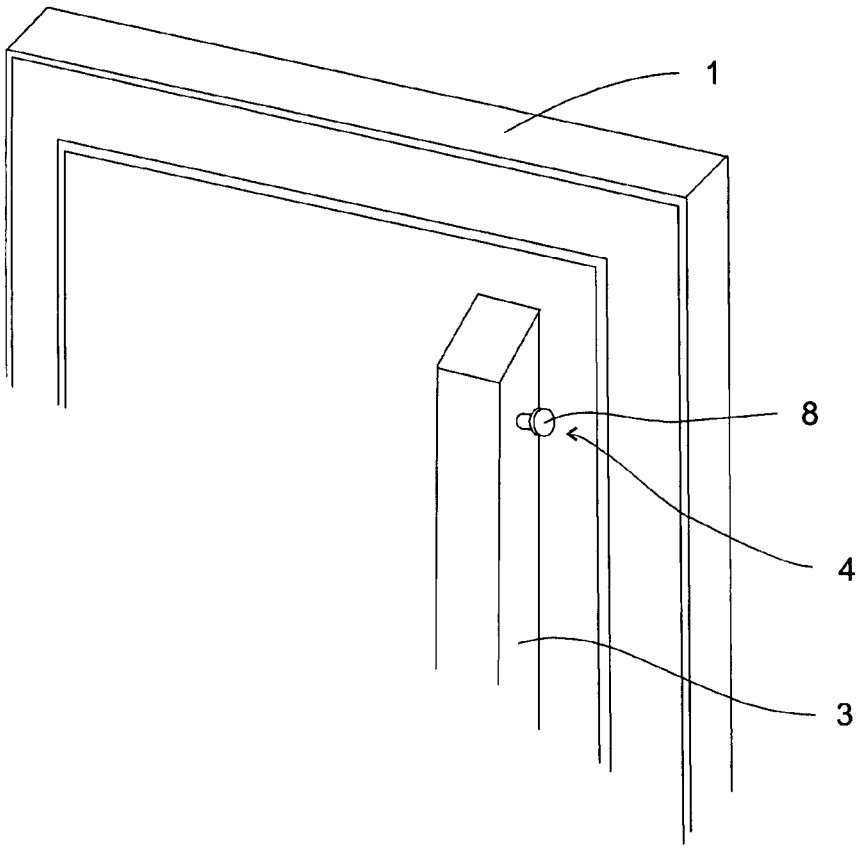
FIG. 2 is a door with a supporting bolt.

As shown in FIGS. 2 and 3, the supporting bolt 4 is affixed to the cross piece 3. The supporting bolt 4 consists of a shaft 7 and a head 8. The head 8 is configured in the form of two superposed circular disks located coaxially to the shaft. In this case, the disk located closer to the shaft 7 has the smaller diameter of the two disks. The shaft 7 is received in the upright member 3 and the smaller disk of the supporting head bolt abuts against the upright member 3.

Figure 4:
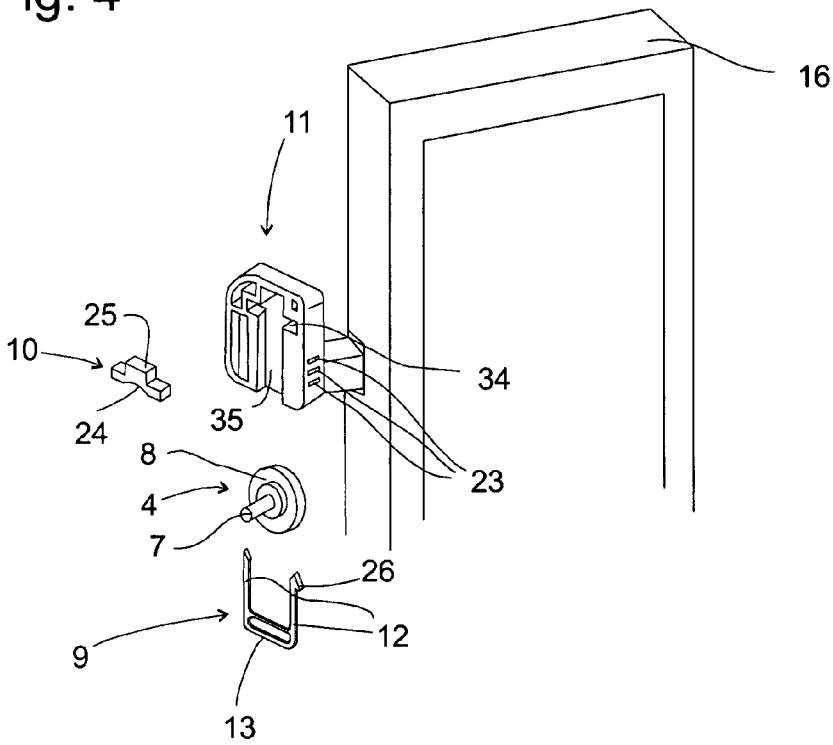
FIG. 4 is an exploded view of a suspension device with pivotable upright member.
Figure 5:
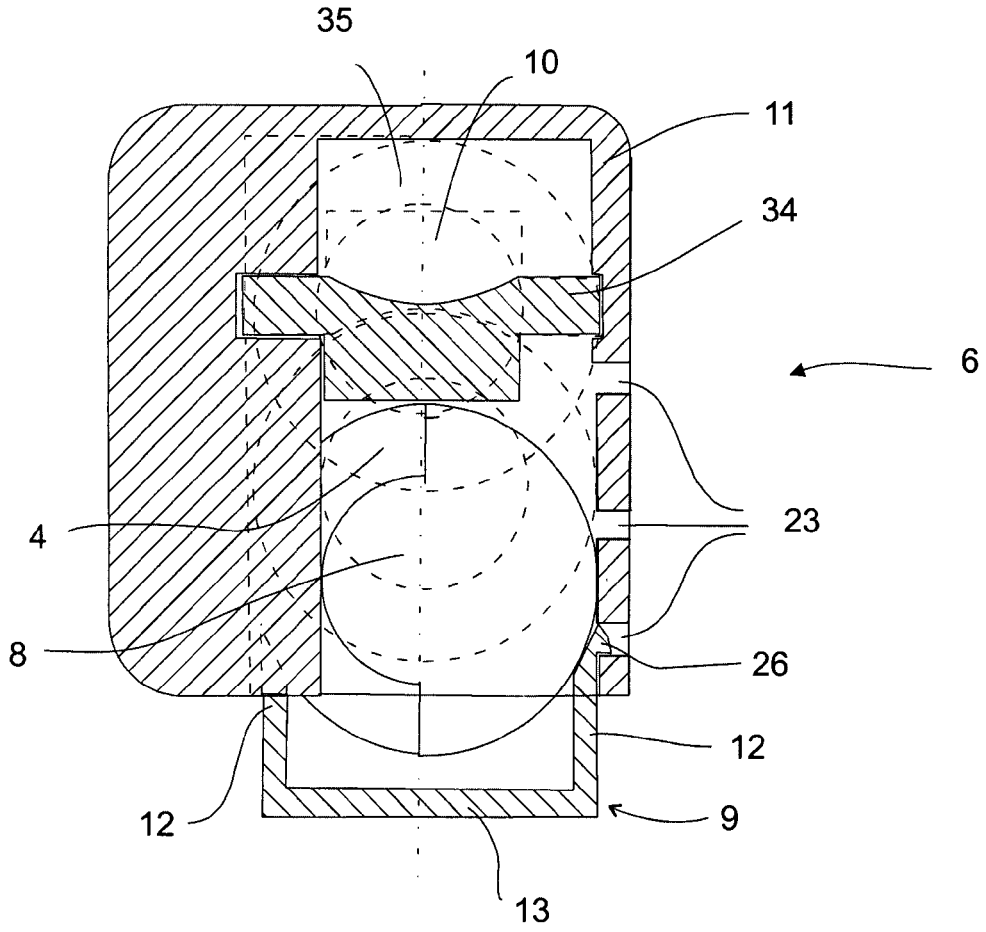
FIG. 5 is a section through the suspension device along the line A-A in FIG. 3.

As shown in FIGS. 3 to 5, the supporting bolt receptacle 11 is a substantially rectangular box which incorporates an undercut channel 35 which runs vertically at the front, i.e. at the side of the box adjacent to the upright member 3 and which is open at the bottom. The channel 35 comprises a narrow entrance region 36 and a broad rear region 37. The head 8 of the supporting bolt 4 is provided for insertion from below into the undercut channel 35. The smaller disk of the head 8 is then located in the narrow entrance region 36 and the larger disk in the broad rear region 37. The undercut prevents the supporting bolt 4 from being able to leave the supporting bolt receptacle 11 in a direction other than the longitudinal direction of the channel 35.

The supporting bolt receptacle 11 is pivotally connected to the pivotable upright member 16 by means of pivoted arm.

The undercut channel 35 crosses a transverse channel 34. The transverse channel 34 is likewise open at the front but not undercut.

In order to hold the supporting bolt 4 at different heights in the supporting bolt receptacle 11, a locking element 10 shown in FIGS. 4 and 5 can be inserted in the transverse channel 34. The locking element 10 consists of a plate-shaped base member having an indentation 24 at one side of the plate. A protuberance 25 is provided on the opposite side of the plate, this being received in the undercut channel 35 when the two longitudinal ends of the plate are inserted in the transverse channel 34. The locking element 10 can be inserted in two orientations in the transverse channel 34. When the locking element 10 is inserted such that the protuberance 25 of the plate points downwards, the protuberance 25 comes to rest on the supporting bolt 4 during mounting of the upright member 16 on the door 1. When the locking member 10 is inserted such that the protuberance 25 of the plate points upwards, the supporting bolt 4 comes in contact with the indentation 24 of the locking element 10, i.e. it can be inserted further into the channel 35. If the locking element 10 is removed, the supporting bolt 4 can slide in the channel 35 as far as its upper end. Thus, three different heights which the pivotable upright member 16 can adopt relative to the door 1 are obtained, an upper height where the locking element 10 is mounted with a downwardly facing protuberance 25, a middle height where the locking element 10 is mounted with an upwardly facing protuberance 25 and a lower height where the locking element 10 is not mounted. These three different heights are shown in particular in the section in FIG. 5 where the supporting bolt 4 is shown as a continuous outline in the highest position and is filled with shading, and in both other positions is only shown as a dashed outline in each case.

A locking component 9 shown in FIGS. 4 and 5 is used to lock the supporting bolt 4 in the supporting bolt receptacle 11. This has two parallel fingers 12 which are each connected to a handle 13 at one of their ends and are provided for insertion into the rear region 37 of the undercut channel 35. The other ends of the fingers 12 are bevelled at their respectively facing sides. One of the two fingers 12 is provided with a locking projection 26 on its side facing away from the other finger 12, which is provided to engage in one of three slits 23 formed in a side wall of the rectangular box and opening onto the rear area of the channel 35.

The locking projection 26 has a front side which is oriented obliquely to the direction of insertion of the locking component 9 in the channel 35, facilitating insertion into the channel 35 by slight elastic bending of the fingers 12 and making it possible for the locking component 9 to slide further upwards after the locking projection 26 has engaged in the lowermost slit 23, and a rear side oriented substantially transversely to the direction of insertion which prevents the locking component 9 from being removed from the channel after the locking projection 26 has engaged in one of the slits.

The slits 23 are placed according to the different positions which the supporting bolt 4 can adopt in the channel 35 so that the projection 26 engages in one of the slits in each case shortly before the tips of the fingers 12 abut against the head 8 of the supporting bolt 4. Thus, any residual freedom of movement of the upright member 18 in the vertical direction relative to the door 1 is minimised.

As can be seen from the section in FIG. 5 in particular, the facing oblique faces at the tips of the fingers 12 lie closely opposite the head 8 of the supporting bolt 4 when the locking component 9 is engaged. When the upright member 16 is raised, the supporting bolt receptacle 11 is moved upwards relative to the supporting bolt 4. In this case, the head 8 presses the tips of the fingers 12 against the side walls of the channel 35 and thereby makes it impossible for the locking projection 26 to slide out from the slit 23. The upright member 16 cannot be released from the door 1 without previously removing the locking component 9.

For dismounting the locking component 9, a tool can be pressed from outside through the respective slit 23 onto the locking projection 26 so that it disengages from the locking projection 23. The locking component 9 can then be removed from the channel 35 and the upright member can be suspended from the supporting bolt 4.

The invention claimed is:

1. A refrigeration device comprising:

a body having at least one inner chamber provided therein;

a first door and a second door that jointly close the inner chamber; and an upright member pivotally mounted on the first door to pivot between an extended position and a retracted position, the upright member having an inner side in the extended position that extends between the first door and the second door when the first door and the second door are disposed to jointly close the inner chamber, the upright member being pivotable relative to the door in connection with an opening movement of the first door, the upright member being adjustable in height relative to the first door so that the upright member is positioned at a selected height throughout movement in and between the extended and retracted positions.

2. The refrigeration device according to claim 1, wherein the first door bears the upright member by means of a suspension device having a vertical channel and a supporting bolt for the upright member that can be fixed at different heights in the channel.

3. The refrigeration device according to claim 2, wherein the channel is closed at one end and a removable locking element that defines the length of the channel is placed in the channel between the closed end and the supporting bolt.

4. The refrigeration device according to claim 3, wherein the locking element is disposable in the channel in at least two positions each of which blocks the channel at different widths.

5. The refrigeration device according to claim 4, wherein the channel has at least one receptacle at which the locking element can engage in different orientations.

6. The refrigeration device according to claim 3, wherein the channel has at least two vertically spaced receptacles in which the locking element can engage.

7. The refrigeration device according to claim 2, wherein the supporting bolt and one wall of the channel define at least one wedge-shaped cavity in which a finger of a locking component engages.

8. The refrigeration device according to claim 7, wherein a locking notch and a locking projection which engages in the locking notch are provided, wherein one of the locking notch and the locking projection is formed on the finger and the other of the locking notch and the locking projection is formed on the one wall of the channel defining the wedge-shaped cavity.

9. The refrigeration device according to claim 8, wherein the locking notch is a through opening in the wall of the channel.

10. The refrigeration device according to claim 8, further comprising a plurality of locking notches provided at different heights.

11. The refrigeration device according to claim 2, wherein the supporting bolt has a head that engages in an undercut of the channel.

12. The refrigeration device according to claim 1, wherein the upright member is pivotable about a substantially vertical axis, and the first door includes a fixed bolt having a shaft extending substantially transverse to the substantially vertical axis, and a head connected to the shaft, the upright member being adjustable in height relative to the shaft.

13. The refrigeration device according to claim 12, wherein the upright member is pivotable about an arm of a suspension device, the suspension device including a substantially vertical channel to slidingly receive the head in one of a plurality of discretely spaced height positions.

14. The refrigeration device according to claim 13, further comprising a locking element that is positionable within the channel in at least two orientations to adjust the height of the head relative to the channel.

15. The refrigeration device according to claim 14, further comprising a locking component to lock the head at the selected height.

16. The refrigeration device according to claim 15, wherein the locking component engages the head at the selected height.

17. The refrigeration device according to claim 1, wherein the upright member is arranged so that it can be adjusted continuously in height to one of a plurality of different height mounting dispositions.

18. A refrigeration device comprising:

a body having at least one inner chamber provided therein;

a first door and a second door that jointly close the inner chamber; and an upright member pivotally mounted on the first door to pivot between an extended position and a retracted position, the upright member having an inner side in the extended position that extends between the first door and the second door when the first door and the second door are disposed to jointly close the inner chamber, the upright member being pivotable relative to the door with an opening movement of the first door, the upright member being adjustable in height relative to the first door so that the upright member is positioned at a selected height throughout movement in and between the extended and retracted positions, wherein the upright member is pivotable about a substantially vertical axis, and the first door includes a fixed bolt having a shaft extending with a substantially horizontal shaft axis passing through the substantially vertical axis, and a head connected to the shaft, the upright member being adjustable in height relative to the shaft axis.

19. The refrigeration device according to claim 18, further comprising a locking component to lock the head at the selected height.

20. The refrigeration device according to claim 19, wherein the locking component engages the head at the selected height.

21. The refrigeration device according to claim 18, further comprising a suspension device including a substantially vertical channel to slidingly receive the head in one of a plurality of discretely spaced heights.

22. The refrigeration device according to claim 18, further comprising a locking element that is positionable to adjust the height of the head relative to the channel.

23. A refrigeration device comprising:

a body having at least one inner chamber provided therein;

a first door and a second door that jointly close the inner chamber; and an upright member pivotally mounted on the first door, the upright member having an inner side that extends between the first door and the second door when the first door and the second door are disposed to jointly close the inner chamber, the upright member being pivotable in connection with an opening movement of the first door and the upright member being adjustable in height relative to at least one of the body and the first door, and the upright member being adjustable in height relative to at least one of the body and the first door, wherein the upright member is arranged so that it can be adjusted in height in steps.

* * * * *